US007131468B2

(12) United States Patent
Schuman et al.

(10) Patent No.: US 7,131,468 B2
(45) **Date of Patent: *Nov. 7, 2006**

(54) METHOD FOR CREATING A READY-TO-USE PRODUCT FROM A CONCENTRATED FORM

(75) Inventors: Allan L. Schuman, Eden Prairie, MN (US); Tina O. Outlaw, Inver Grove Heights, MN (US); Keith E. Olson, Apple Valley, MN (US); James E. Skavnak, Minneapolis, MN (US)

(73) Assignee: Ecolab Inc., St. Paul, MN (US)

( * ) Notice: Subject to any disclaimer, the term of this patent is extended or adjusted under 35 U.S.C. 154(b) by 171 days.

This patent is subject to a terminal disclaimer.

(21) Appl. No.: 10/434,430

(22) Filed: May 8, 2003

(65) Prior Publication Data

US 2004/0045984 A1 Mar. 11, 2004

Related U.S. Application Data

(60) Provisional application No. 60/379,918, filed on May 10, 2002, provisional application No. 60/400,592, filed on Aug. 1, 2002, provisional application No. 60/403,607, filed on Aug. 14, 2002, provisional application No. 60/406,087, filed on Aug. 26, 2002.

(51) Int. Cl.
*B65B 1/04* (2006.01)
*C11D 11/00* (2006.01)

(52) U.S. Cl. ..... 141/2; 141/9; 141/18; 141/94; 141/100; 141/104; 510/406

(58) Field of Classification Search ..... 141/9, 141/100, 104, 2, 18, 94; 53/468, 474; 510/406
See application file for complete search history.

(56) References Cited

U.S. PATENT DOCUMENTS

| | | | | |
|---|---|---|---|---|
| 3,640,430 A | | 2/1972 | Roberts | 222/1 |
| 4,469,150 A | | 9/1984 | Grimaldi | 141/95 |
| 4,567,926 A | | 2/1986 | Lichfield et al. | 141/332 |
| 4,590,974 A | | 5/1986 | Mathews | 141/1 |
| 4,928,853 A | | 5/1990 | Isham et al. | 222/108 |
| 4,929,818 A | | 5/1990 | Bradbury et al. | 235/381 |
| 4,976,137 A | | 12/1990 | Decker et al. | 73/53 |
| 5,020,917 A | * | 6/1991 | Homan | 366/160.4 |
| 5,203,366 A | | 4/1993 | Czeck et al. | 137/3 |
| 5,259,557 A | | 11/1993 | Spriggs et al. | 239/304 |
| 5,275,313 A | | 1/1994 | Petrillo et al. | 222/377 |
| 5,344,074 A | | 9/1994 | Spriggs et al. | 239/10 |
| 5,474,184 A | | 12/1995 | Mandler et al. | 206/519 |
| 5,584,327 A | | 12/1996 | Thomas et al. | 141/104 |

(Continued)

OTHER PUBLICATIONS

*CCCOI-Chem News*, Brief Article, "Green, clean and On Tap. (Asda offers laundry detergent sold via vending machines)", 2 pages, (Nov. 2001).

*Primary Examiner*—Lorna M. Douyon
(74) *Attorney, Agent, or Firm*—IPLM Group, P.A.

(57) ABSTRACT

A method for creating a ready-to-use product from a concentrated form comprises providing a source of locally supplied diluent to a dispenser having a fill station, providing a container of first concentrate at a remote site, providing a first product container, identifying the container by the dispenser, placing indicia with the fill date on the first product container and filling the container with the diluent and the concentrate.

14 Claims, 15 Drawing Sheets

U.S. PATENT DOCUMENTS 5,597,019 A 1/1997 Thomas et al. ..... 141/18
5,651,398 A * 7/1997 Decker et al. ..... 141/18
5,655,563 A 8/1997 Johnson ..... 137/115.15
5,738,135 A 4/1998 Johnson ..... 137/119.06
5,746,238 A 5/1998 Brady et al. ..... 137/3
5,799,831 A 9/1998 Spriggs et al. ..... 222/132
5,810,201 A 9/1998 Besse et al. ..... 222/39
5,816,446 A 10/1998 Steindorf et al. ..... 222/1
5,832,972 A 11/1998 Thomas et al. ..... 141/360
5,836,479 A 11/1998 Klima et al. ..... 222/83.5
5,862,948 A 1/1999 Duchon et al. ..... 222/133
5,915,592 A 6/1999 Mehus et al. ..... 222/1
5,954,240 A 9/1999 Duchon et al. ..... 222/484
5,960,840 A 10/1999 Simmel et al. ..... 141/346
5,961,011 A 10/1999 Thomas et al. ..... 222/541.6
6,056,012 A 5/2000 Yuen et al. ..... 137/614.2
6,079,595 A 6/2000 Meyer et al. ..... 222/181.3
6,170,543 B1 1/2001 Simmel et al. ..... 141/346
6,220,482 B1 4/2001 Simmel et al. ..... 222/83
6,553,352 B1 4/2003 Delurgio et al. ..... 705/400
6,553,353 B1 4/2003 Littlejohn ..... 705/412
6,578,763 B1 6/2003 Brown ..... 235/435
6,705,358 B1 * 3/2004 Tortorici et al. ..... 141/9
2002/0030102 A1 3/2002 Brown ..... 235/435
2003/0051767 A1 * 3/2003 Coccaro et al. ..... 141/351

* cited by examiner

METHOD FOR CREATING A READY-TO-USE PRODUCT FROM A CONCENTRATED FORM

This application claims the benefit of U.S. provisional patent application Ser. No. 60/379,918 filed May 10, 2002; and U.S. provisional application Ser. No. 60/400,592 filed Aug. 1, 2002; and U.S. provisional application Ser. No. 60/403,607 filed Aug. 14, 2002; and U.S. provisional application Ser. No. 60/406,087 filed Aug. 26, 2002, all of which are entitled "Apparatus and Method for Creating a Ready-To-Use Product From a Concentrated Form".

FIELD OF THE INVENTION

The invention is generally related to an onsite apparatus to prepare aqueous cleaning compositions. In particular, the apparatus delivers a concentrated form of a product, which is diluted, and dispensed into a container where it is in a ready-to-use concentration by consumers.

BACKGROUND OF THE INVENTION

There have been numerous dilution systems developed and patented over the years. These dilution systems come in a variety of formats, but typically take a concentrated liquid and create a ready-to-use product through the addition of water. Examples of patents directed to this general concept include the following: U.S. Pat. Nos. 4,976,137; 5,203,366; 5,259,557; 5,344,074, 5,584,327; 5,597,019; 5,810,201; 5,651,398; 5,746,238; 5,655,563; 5,738,135; 5,799,831; 5,832,972; 5,816,446; 5,915,592; 5,961,011; 6,056,012; 6,079,595. The use of one use, pre-filled containers is also environmentally unsound. The containers are used only once and extra energy is used to transport water, which is a large portion of most ready-to-use products.

However, to date, there has not been an adequate system wherein a consumer can readily activate a dispensing system which delivers a ready-to-use product to a container in a safe and economical manner.

SUMMARY OF THE INVENTION

The present invention is directed to an apparatus and a method for diluting a concentrate and forming a ready-to-use product for consumers. The apparatus comprises a dispenser having one or more filling stations wherein a container is filled with a ready-to-use product. In one embodiment, a container is placed at the filling station; a filling nozzle adds a concentrated product to the container along with a predetermined amount of water to dilute the concentrated product. The end result is a container having a ready-to-use product. In one embodiment, the water is available locally and further, the containers may be recyclable, both of which are environmental improvements.

The method to achieve the ready-to-use product requires a user to a) identify a product to be dispensed; b) place the container in the filling station; and c) allow the dispenser to fill the container. Thereafter the user or the dispenser automatically secures a top to the container. Alternatively, the container may have a top already on it with a one-way valve useful for filling.

In another embodiment, the invention is a method of diluting chemical concentrates to form a ready-to-use consumer product for consumer markets. The method includes providing a source of diluent to a dispenser having a filling station. A first container having a first concentrate is provided. A second container having a second concentrate is provided. A first product container is provided and the first product container is placed in the fill station. The first product container is filled with an amount of diluent, first concentrate and second concentrate in a predetermined amount. In another embodiment, the first concentrate has a first viscosity and the second concentrate has a second viscosity, upon mixing the concentrates form a mixture having a viscosity higher than the viscosities of the concentrates, whereby when mixed with the diluent, forms the ready-to-use consumer product having a viscosity greater than 150 cps.

In another embodiment, the invention is a method of diluting a chemical concentrate to form a ready-to-use consumer product for consumer markets. The method comprises providing a source of diluent to a dispenser having a filling station. A container of a first concentrate is provided and a first product container is provided. The first product container is placed in the fill station. The concentrate is pumped into a low pressure area of a venturi while providing a flow of diluent to the venturi. The first product container is filled from the venturi.

In another embodiment, the invention is an apparatus for diluting a chemical concentrate to form a ready-to-use consumer product for consumer markets for filling into a container. The apparatus comprises a dispenser housing and a fill station. A source of concentrate is operatively connected to the fill station. A source of diluent is operatively connected to the fill station and the fill station has a nozzle assembly. The nozzle assembly comprises a dispensing tube having a bore having an inlet and an outlet. The inlet is in fluid communication with the diluent and concentrate. The exit is adapted to be in fluid communication with the container. A plug is moveable between a closed position and a dispensing position. A connecting member having a first end operatively connected to the plug and a second end is provided. An actuator is operatively connected to the second end of the connecting member, wherein the actuator moves the plug between the closed position and the dispensing position.

In another embodiment, the invention is an apparatus for diluting a chemical concentrate to form a ready-to-use consumer product for the consumer markets for filling into a container. The apparatus includes a dispenser housing and a fill station. A source of concentrate is operatively connected to the fill station. A source of diluent is operatively connected to the fill station. The fill station has a nozzle assembly. The nozzle assembly comprises a dispensing tube having a bore having an inlet and an outlet. The inlet is in fluid communication with the diluent and concentrate. The exit is adapted to be in fluid communication with the container. A housing is operatively connected to the two approximate the inlet of the bore, the housing forming a chamber. A housing inlet member has a first end in fluid communication with the concentrate and diluent and a second end in fluid communication with the chamber. A first check valve has a first opening to the atmosphere and a second end in the chamber. The first check valve allowing air into the chamber and a second check valve operatively connected in the housing inlet member allowing flow into the chamber, wherein when the diluent and concentrate are not flowing through the inlet member, the first check valve allows air into the chamber to aid in having all diluent and concentrate drip from the dispensing tube.

In another embodiment, the invention is a method of diluting a chemical concentrate to form a ready-to-use consumer product for consumer markets. The method includes providing a source of diluent to a dispenser having a fill station. A concentrate container having a first concentrate is provided. A first product container is provided. One of the first product containers is picked and is placed in the fill station. The product container is filled at the fill station with an amount of diluent and concentrate in a predetermined amount. An indicia is placed on the product container, the indicia identifying a date.

In another embodiment, the invention is a method of making a chemical concentrate to form a foamable ready-to-use consumer product for consumer markets. The method includes providing a source of locally supplied diluent to a dispenser having a fill station. A container of a first concentrate is provided in a housing separate from the fill station. A first product container is provided. One of the containers is picked and placed in the fill station. The container is identified by the dispenser and the container is filled at the filling station with an amount of diluent and concentrate in a predetermined amount, having a viscosity of 800 cps or less.

DETAILED DESCRIPTION OF THE INVENTION

The dispenser apparatus of the current invention and the method for filling containers of the current invention has many different features and steps. There are a number of different products which may be dispensed in the present invention. A list of at least some of the products envisioned being dispensed in the present invention include laundry detergent, pot and pan detergent, automatic dishmachine detergent, window cleaners, hard surface cleaners, bathroom cleaners, kitchen cleaners, degreasers, hand soap (liquid), toilet cleaners, floor cleaners, car cleaners and other car care products, concrete cleaners, kitchen and sink cleaners, tile cleaners, shower cleaners, and other household types of cleaners. The foregoing is not an exhaustive list. Any product may be dispensed that can be made from a concentrate and be diluted to a ready-to-use product.

The dispensers of the present invention may typically be located in supermarkets, warehouse clubs, building supply stores, convenience stores, mass merchandisers, or any other store that typically sells detergents and cleaners. The dispensers could be placed alongside the competing products, or at the end of a row containing the cleaners or sanitizers.

The present invention has many advantages. One advantage is there is less product being shipped to the various stores. Since only the concentrated product is being shipped, and the product is being diluted with water available at the store, less product is shipped. This results in lower shipping costs. Another advantage is the fill containers or concentrate containers may be reusable, thus the same container could be brought in a number of times and refilled or in the case of the concentrate container, the container could be sent back to the plant for refill of the concentrate, thus reusing the totes or drums. This has the pro-environmental aspect of recycling containers while using less fuel for shipping. The fill containers also may be collapsible; thus they could be shipped in a collapsed form which would reduce the volume of the products being shipped. These features and others result in an environmentally friendly product which could be priced lower than competitive products, thus providing a cheaper product for the consumers, as well as increased profit for the supermarket or store owner.

Figure 1:
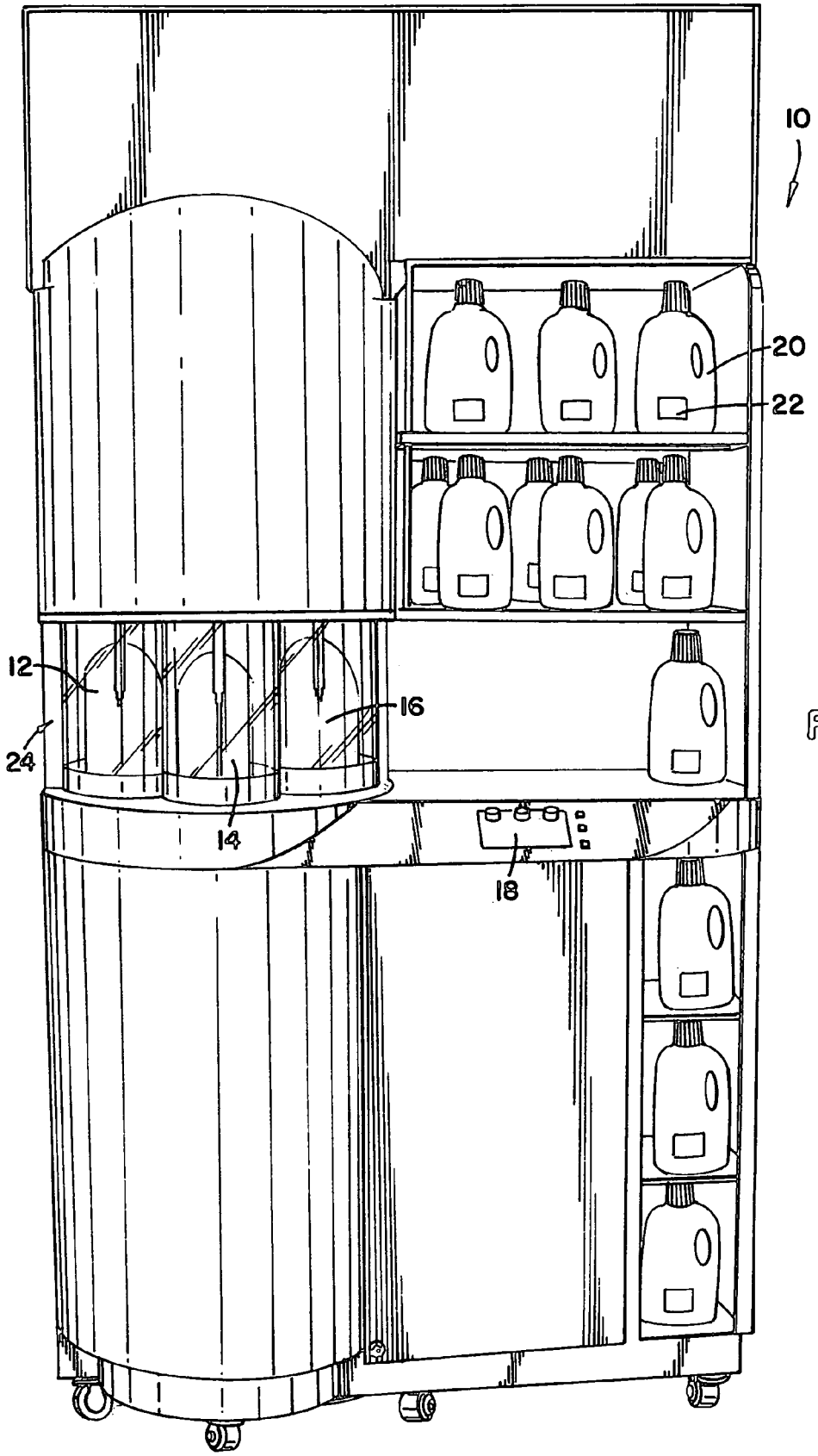
FIG. 1 is a schematic of the dispenser of the present invention.
Figure 2:
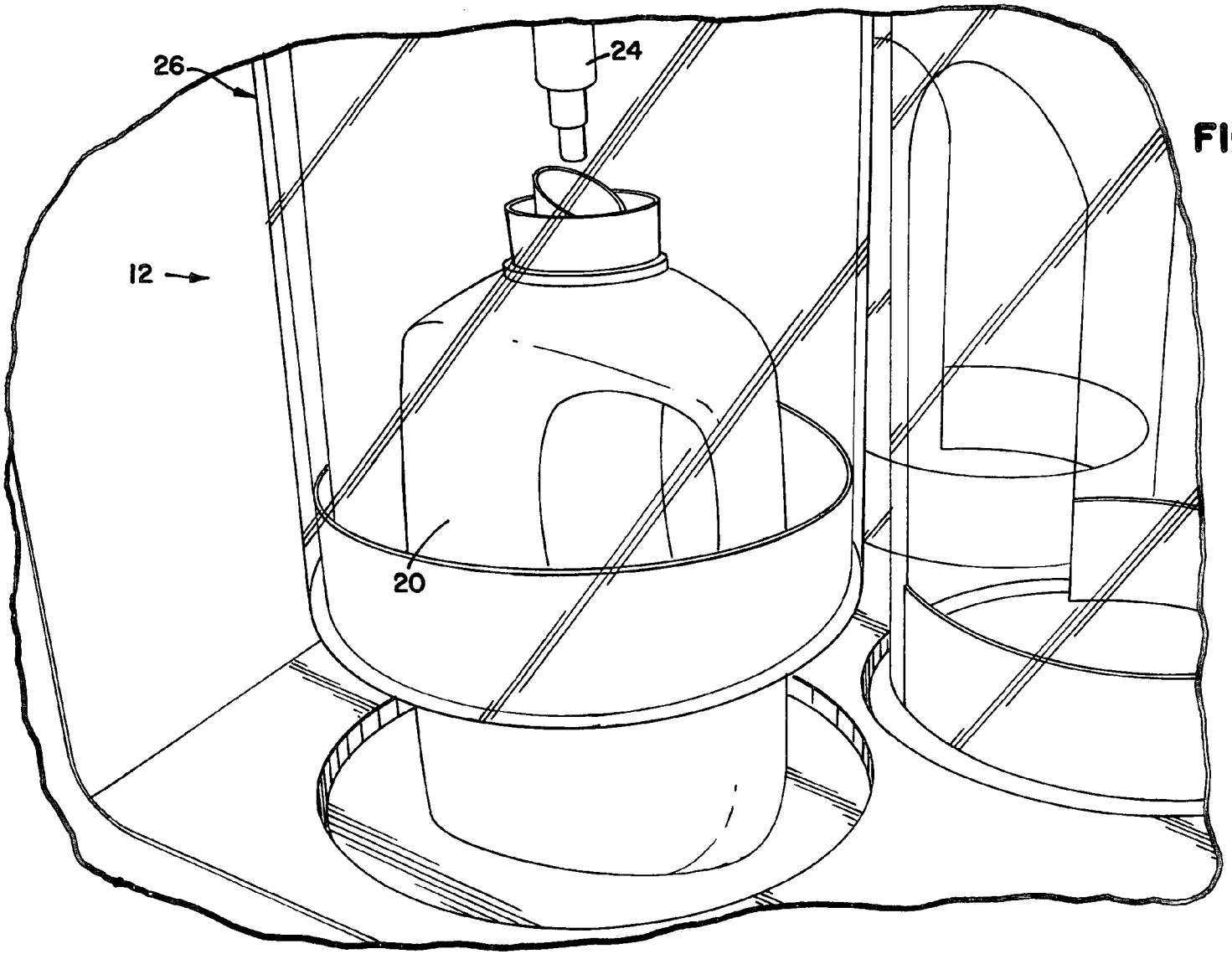
FIG. 2 is a schematic of a close-up of a fill station of the present invention.
Figure 3:
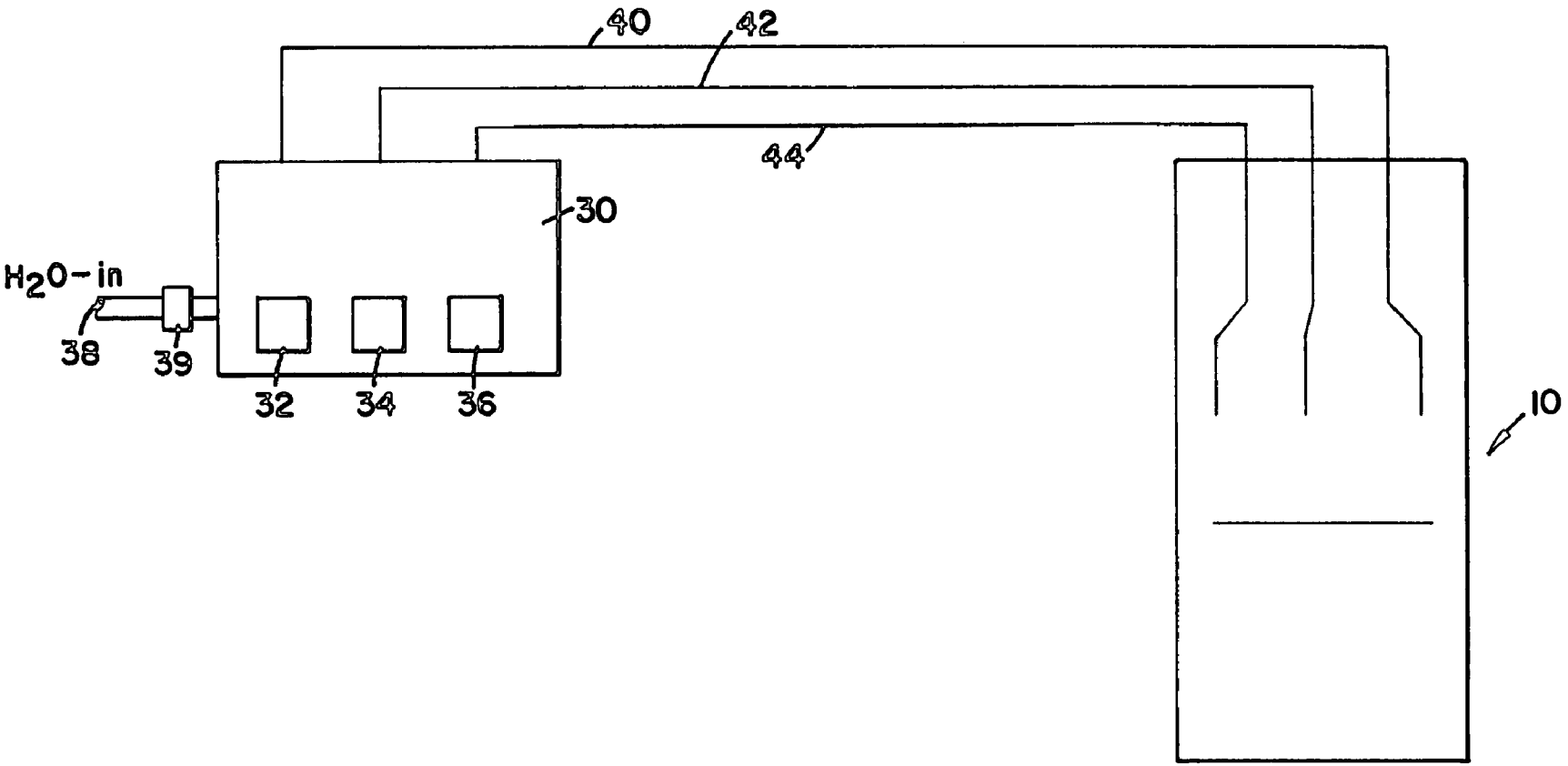
FIG. 3 is a block diagram illustrating placing the concentrate containers at a site remote from the dispenser.
Figure 4:
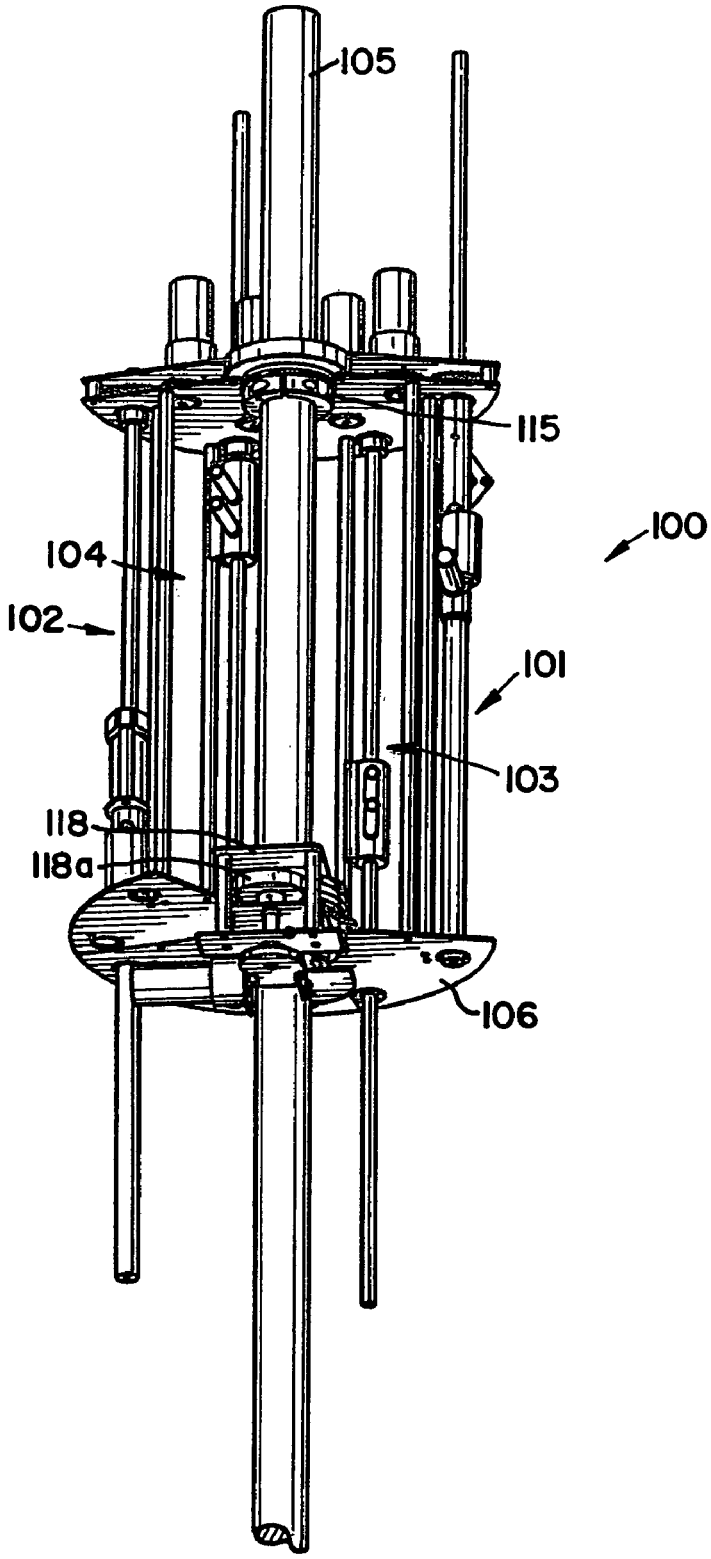
FIG. 4 is a second embodiment of showing a turret assembly for filling stations.
Figure 5:
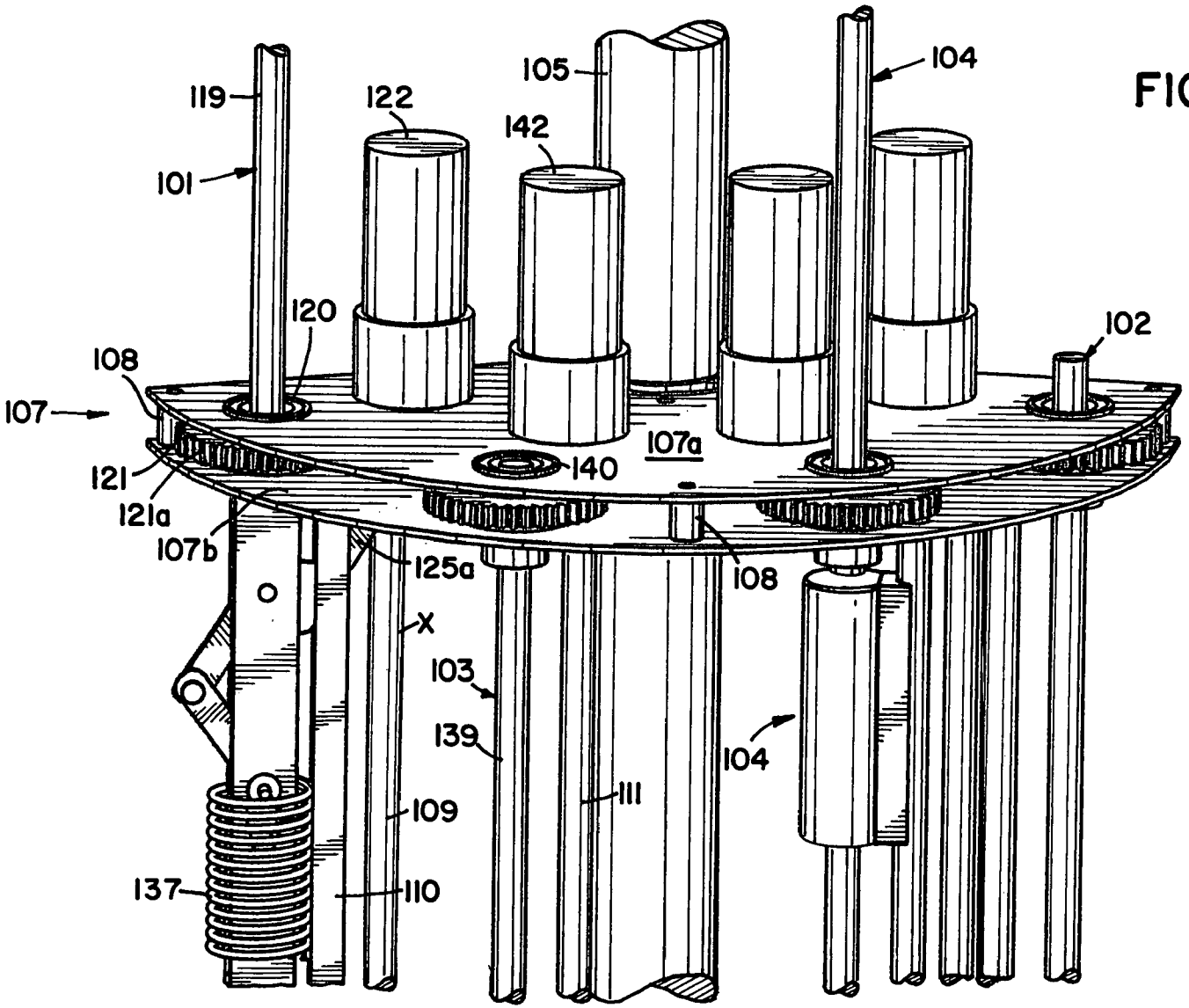
FIG. 5 is an enlarged perspective view of a portion of the turret assembly shown in FIG. 4.
Figure 6:
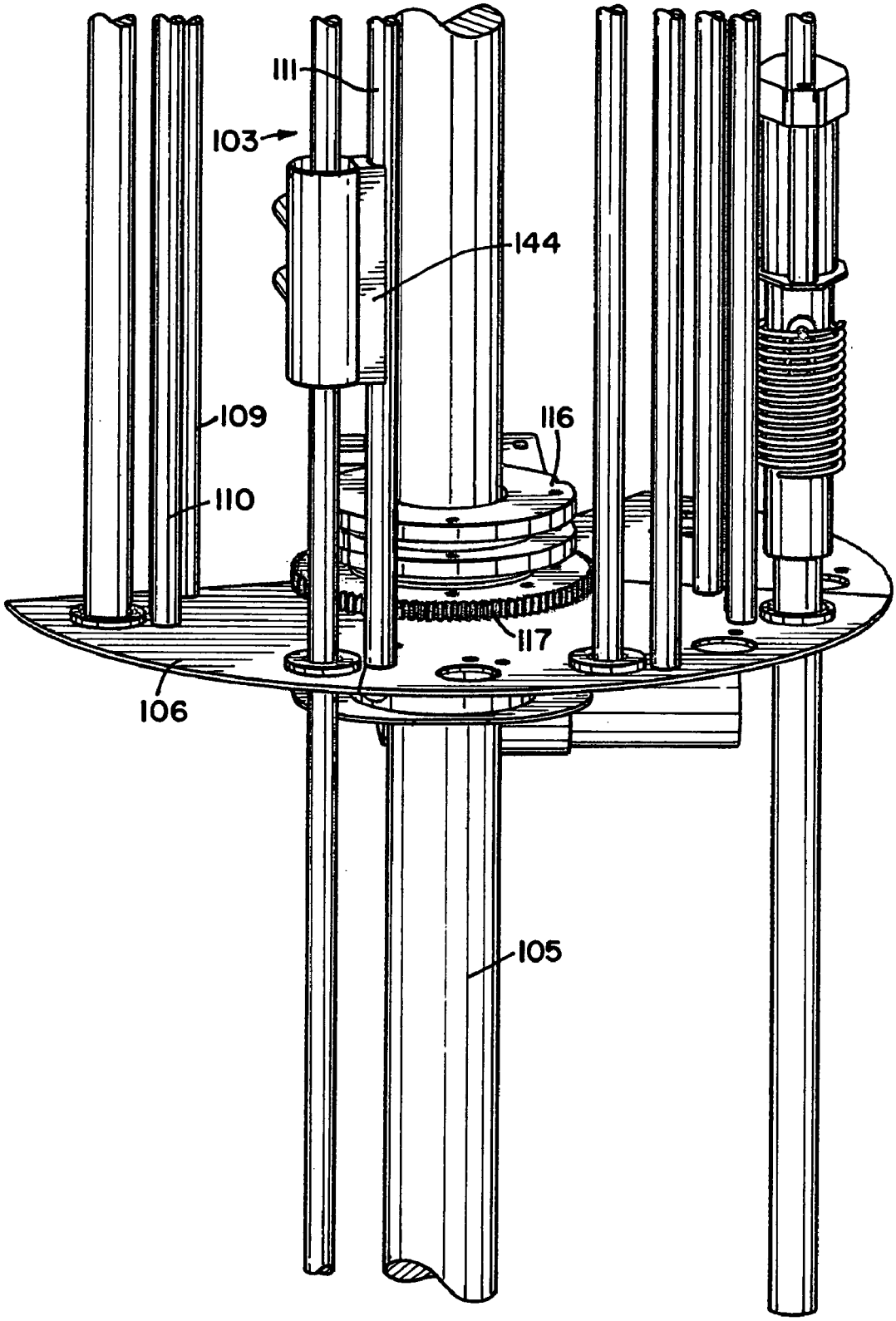
FIG. 6 is an enlarged perspective view of a portion of the turret assembly shown in FIG. 4.
Figure 7:
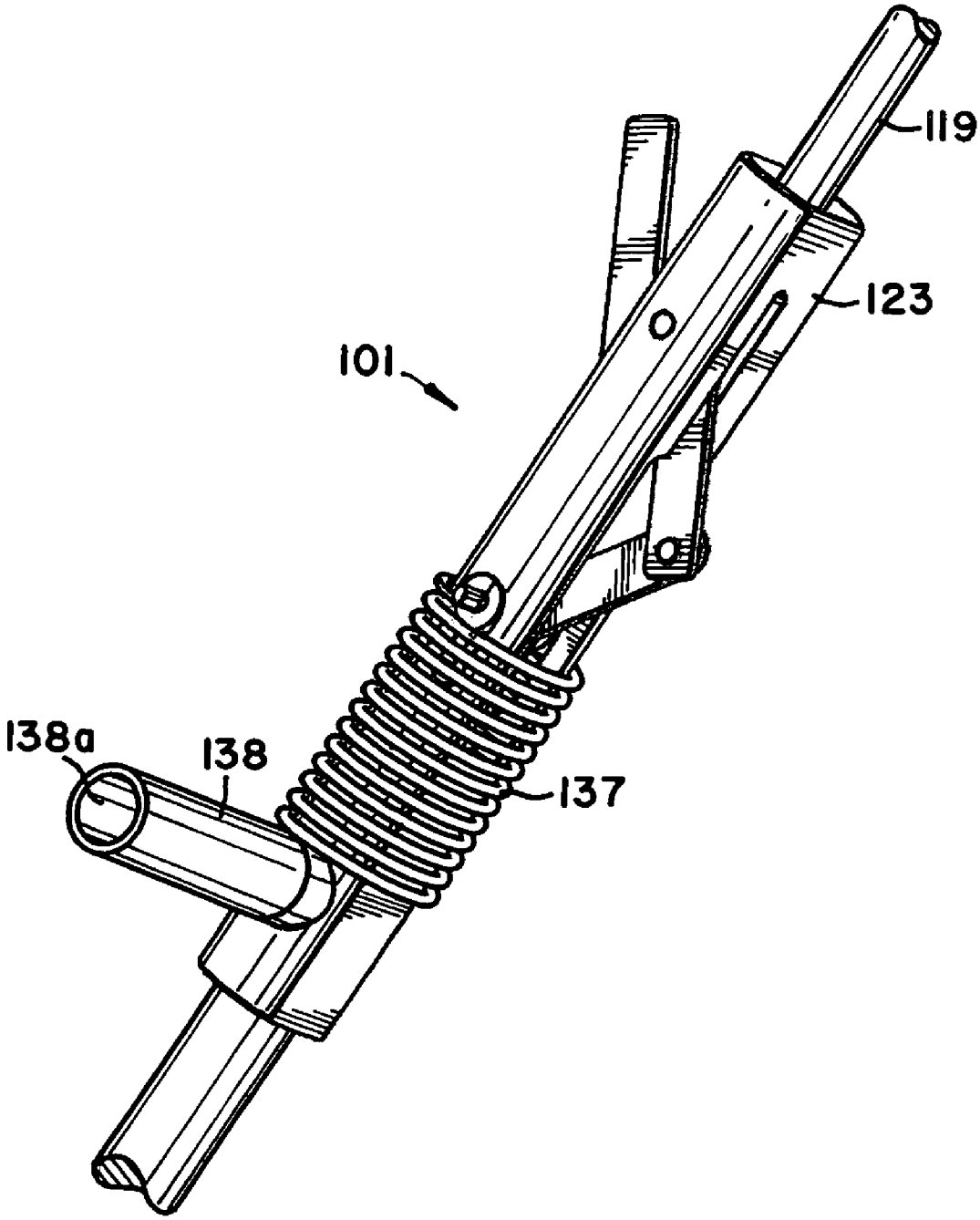
FIG. 7 is a perspective view of a portion of a nozzle assembly shown in FIG. 5.
Figure 8:
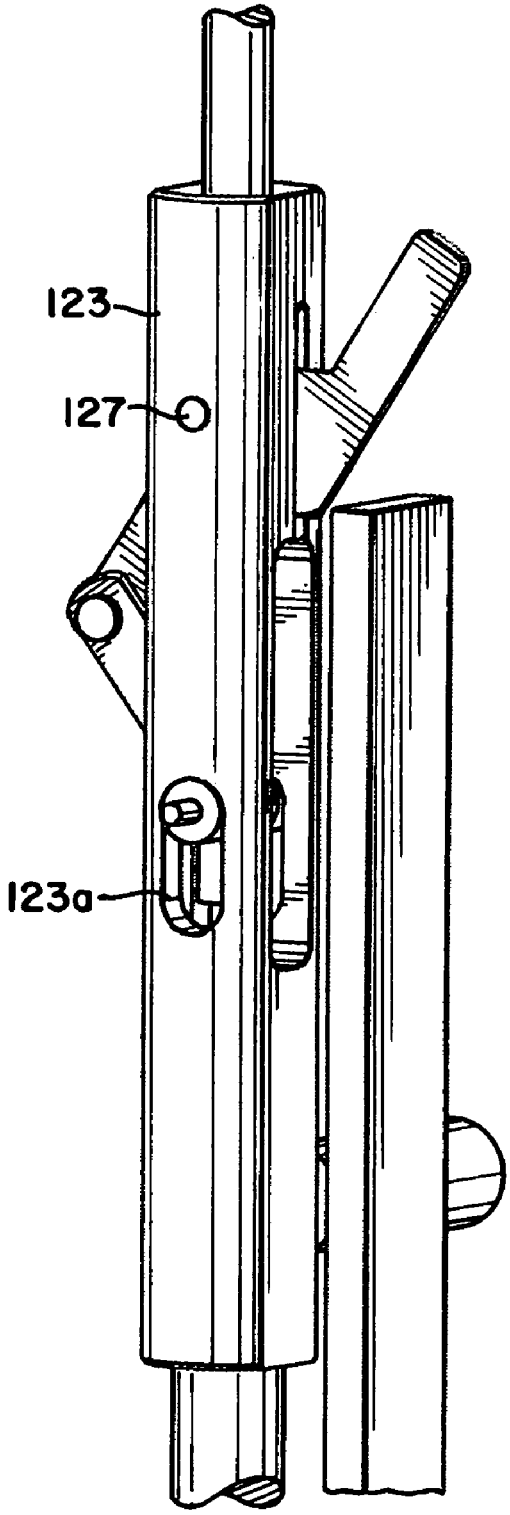
FIG. 8 is a perspective view of a nozzle assembly shown in FIG. 7 with a spring removed and a slide plate added.
Figure 9:
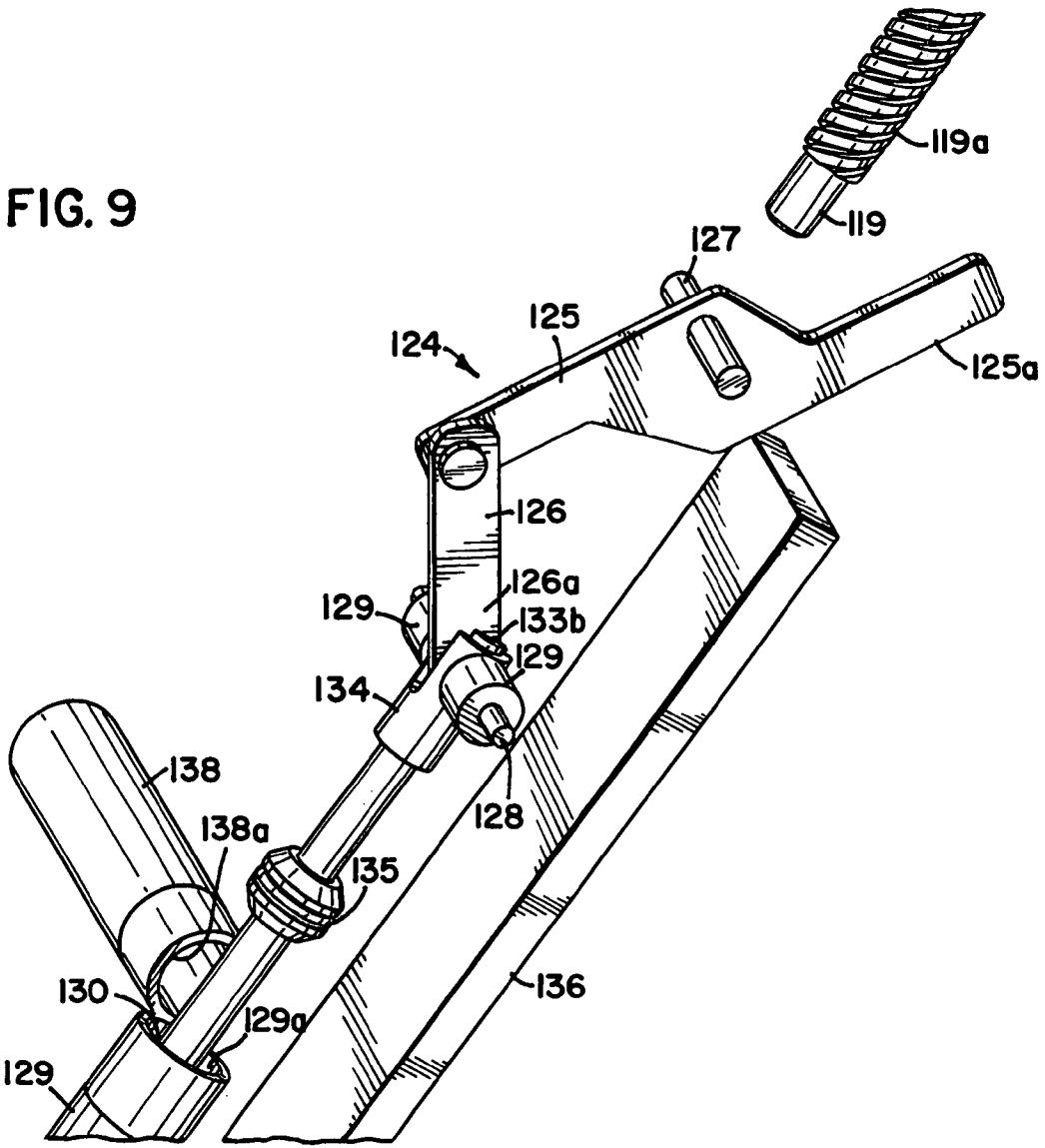
FIG. 9 is a perspective view of the nozzle assembly shown in FIG. 9 with the outer housing removed.

The present invention, which is shown in FIGS. 1, 2 and 3, discloses a dispenser 10 having filling stations 12, 14 and 16, and information screen 18. Each individual filling station typically will have a source of concentrated product as well as a source of water, or the two materials could be delivered to the filling station as a premixed single material. The filling station also will have some marking indicating what type of product it is associated with. Thus, in one embodiment of the present invention, a container 20 is placed in the filling station 12, wherein a concentrated product is filled into the container 20, either already diluted or followed with a diluting step of adding water after the concentrate has been added. The premixing may occur in a reservoir or inline prior to filling the container. Typically, there will be large reservoirs of concentrated product located within the dispenser or in a room located away from the dispenser. For the purposes of this invention, placing the concentrate containers away from the dispenser will be referred to as being in a "remote site." A remote site will be a site usually some distance from the distance, usually out of sight of the users of the dispenser such as a back room. However, it could include being located on the other side of a wall, or in another aisle. As another option, the concentrates may be contained in a separate housing from the fill station, as in the remote site, but could be located next to or under the filler station or anywhere which is not at the dispenser.

These reservoirs will contain a concentrated product form of the product being dispensed. The concentrate can be a solid, liquid, paste, granular or liquid. Liquid is preferred. For example, if a pot and pan detergent is being dispensed, there may be a 5-gallon container of concentrated liquid pot and pan detergent in the dispenser or in a back room, wherein there will be some means to pump or pull a portion of the pot and pan concentrate from the container to the filling station. The use of a back room removes any practical limits to the size of the containers, and it is envisioned there may be 5-gallon or 55-gallon drums of concentrate located in an adjacent area, which is thereafter pumped to the dispenser and ultimately to the filling station.

In one embodiment of the present invention, a user would select a container 20 which may have some label 22 on it indicating what type of product will be filled within the container. The label 22 could include a UPC bar code, spot mark, or photo recognition of the container to identify the product, size and other information. Thus, as shown in the figures, a nonlimiting example could be one fill station 12 dispensing a pot and pan detergent, another fill station 14 dispensing a window cleaner, and a third fill station 16 dispensing an all-purpose cleaner. There may be available alongside the dispenser 10 or attached to the dispenser 10, a variety of containers 20 with different labels associated with the type of product to be dispensed into the container. A user would select the desired product container and place it in one of the filling stations. The filling stations and/or product label may be color-coded or shape coded to assist the user in knowing which filling station to use. Additionally, the filling station may have a matching label with the product. As another alternative, the filling station would read what type of container is in the filling station, using bar codes, container configuration, or other sensing means. This would permit for using only one filling station. After the product is determined by the bottle selection and the reading of the scannable code, bar code or UPC code when the bottle is placed in the filling station, the filling station would select the proper fill nozzle to fill the container with the proper product. The container itself could have molded into it some type of identifier such that when it is placed in the filling station, the filling station recognizes that particular container.

The filler station may also be equipped with an arm to receive the container to be filled and move the container to the proper position to be filled. Holding the container in this position until it is filled and the return it to the customer by moving it out of the filler back to easy reach of the customer.

As is shown in FIG. 2, at the filling station 12, a nozzle 24 lowers, and begins filling the container 20 with the concentrated product. Concurrent with this, the same nozzle could be dispensing a source of water, or a second nozzle may be lowered into the container to fill with water. The preferred mode is to premix the diluent (typically water) with the concentrate prior to introduction to the container. This premixing could occur at the remote site or at the dispenser or in the piping between the two.

There are many safety features that can be included in the present invention. A shield 26 maybe lowered around the container prior to dispensing the product into the container. This shield 26, preferably transparent, would prevent product from spraying out on the customer or floor in the event there is a malfunction in the nozzle or the container tipped over. This shield 26 could have a safety mechanism wherein if the shield 26 sensed something in its path, it would raise again thus preventing someone's hand or body part from getting pinched or crushed by the shield.

Another safety feature could be at each filling station, there would be perforations holes or drains at the bottom of each filling station wherein spilled product will flow into either a holding tank or directed to a drain in the facility holding the dispenser. When the holding tank is filled, an automatic level switch could be used to shut the filling station down to prevent a spill of product.

Another possible feature of the dispenser could include a particular footprint for each container, wherein it would be very difficult to put the wrong container in the wrong fill station. For instance, the footprint of one container could be a triangle, the second container could be a square, and the third container could have a circular footprint or base. The dimensions of these could be set such that the wrong container could never be put in the fill station due to the footprint of the container not matching the recess in the fill station. Additionally, there could be projections either extending from the fill station or from the container which would have to be matched up in a lock and key-type configuration otherwise the container would not fit. Changes in the footprint of the bottles along with the UPC code could be used to fill different sized container for different products. Further, one station may have multiple footprints. That is, the station may have multiple level footprints of different shapes superimposed on each other to provide for centering of different shaped/sized containers.

As shown in FIG. 1, there could be a separate screen 18, which may have a separate keypad or which may be a touch sensitive screen. For one embodiment, the screen could be a touch screen wherein the user would select the product at the screen level. Additionally, the screen could display instructions, information about the products, advertising, or any other information that may be desirable to be communicated to the user. The financial advantages of the dispensed product versus the competitive products could be compared, with the daily prices of each being entered in a manner similar to the entry of prices into the stores scanner system. Thus if a competitive product was on sale, the comparison could be adjusted, and even the price of the dispensed product could be automatically lowered to better compete against the competitive product. In this way, the dispensed product could be programmed to always stay, for example, $2.00 cheaper than the competing product. So every time the competing product went on sale, the dispensed product would decrease in price accordingly. The system could also be interacted with online or electronically from a distant location to change pricing, advertising, troubleshooting or monitor sales.

The present invention could utilize one fill station, or many fill stations. One fill station could dispense different products, through the use of additional nozzles, or compatible products could be dispensed through the same nozzle/hose wherein any residual product being dispensed into another product would not have a negative impact on the performance or quality of the product. These products are hereinafter referred to as "nozzle compatible products."

As an alternative, each fill station could include a nozzle wherein two tubes are directed into the nozzle, one containing the concentrate and the other containing a source of water. To increase the speed at which the containers may be filled, both the concentrate and the water could be dispensed into the container at the same time. As another alternative, the water could be added first followed by the concentrated product, or the concentrated product could be added first, followed by the water, or the two could be mixed very quickly in a separate reservoir located near the fill station. Thereafter, the reservoir could be dispensed or dumped into the container quickly.

FIG. 3 shows an embodiment wherein concentrated products are located in a remote site from the dispenser. In FIG. 3, it is envisioned that the concentrated products would be in drums or large containers located in a single station shown as 30 which typically may be in the back room of a supermarket or mass merchandiser. There may be three concentrated products 32, 34 and 36. There also will be an inlet 38 for diluent, such as water, into station 30. In station 30, mixing would occur between the concentrated product and the diluent, which would thereafter be delivered, to the dispensing system in hoses or pipes 40, 42 and 44. Thereafter, a customer would use the dispenser 10 in the manner described herein.

The mixing which occurs in station 30 could be through the use of an aspirator, and could be a done in a mixing reservoir, or could merely be both introduced through a series of pumps into the corresponding pipe to be delivered to the dispenser 10. The advantage of having the storage and/or mixing away from the dispenser is multi-fold. The first advantage is larger containers could be put in a back stock room than typically could be placed in or adjacent to the dispenser. Thus, a typical dispenser may only be able to hold beneath it three 5-gallon pails of concentrated product, wherein a 5 or 55-gallon drum could be used in a back room. This would minimize the number of times store personnel would have to retap a new concentrated product. Another advantage is any potential spillage which may occur from time to time as a result of the storage of the concentrated products and/or mixing would be a back room, rather than in the store front. Having the larger concentrated products in the backroom also facilitates the ease of the delivery of the product and minimizes the movement of the product from the shipping dock to the store. Also, more products may be dispensed in a given in store space by having the dispenser 30 in a remote site. Further, there are fewer connections in the store when the dispenser is in the remote site.

The present invention can easily be modified to change products based on varying local geographic needs. For example, in areas where environmental concerns may be of particular importance, the products may be blended using environmental friendly ingredients. Water quality also varies throughout the country and the recipes for making the products may change based on water hardness, water pH, iron level of the water, etc. Thus, the formula in one geographic for detergent may differ from a dish detergent for a different geographical area. The product selection could vary, depending on local preferences. Buying preferences such as window cleaners, liquid pot and pan detergents, and all-purpose cleaners vary geographical, thus the availability of these products could be changed. Choice of fragrances also is local specific, so different fragrances could be used in different geographical locations.

Finally, a single dispenser 10 could be used to dispense many types of products, all from a single dispenser. This dispenser may dispense 20 or 30 different types of products, wherein there is a rinse of the lines between each of the dispensing. It is envisioned that a window cleaner could be dispensed. A brief cleaning of the lines would occur which would be followed by the dispensing of a laundry detergent. The cleaning of the lines could be achieved by a pure water rinse, or may involve some cleaner or method which would not contaminate the various products dispensed through the lines.

Water, to dilute the concentrate, is obtained locally with respect to the retail store. That is, the water is not shipped in to the retail store. The obtaining of the water locally is a major cost savings in that water does not have to be shipped in. In the areas wherein there are water hardness problems, a pretreatment step could be implemented wherein the water would be softened, filtered or otherwise conditioned prior to diluting the concentrated product. This could be achieved easier if all of the mixing and the location of the concentrated products was in a remote site. A pretreatment apparatus 39, such as a water softener, is in fluid communication with the inlet 38 and with the dispenser 30.

The container shown as 20 could come in a variety of sizes. These sizes could be matched with the product being dispensed therein. An additional smaller bottle which could be filled from the larger bottle could also be attached to the larger container. Thus, the main container 20 could be sized to receive 1 or 2 liters of a product, wherein a small squirt attached bottle would be attached to the container such that when the consumer brought the product home, the consumer could pour from the larger bottle into a small, easier to handle bottle, such as a ½ liter bottle.

The top of the containers could include a wide variety of tops or caps. Examples include but are not limited to a spray nozzle, a squirt nozzle, or a one way valve which the nozzle would penetrate and fill, afterward pulling out. This one way valve could be thereafter opened by the consumer by different mechanisms. The key of the top is it must not leak or drip, and may be put on by easily the user or automatically by the dispenser.

If the top or cap to be placed on the container 20 is done automatically, it may be done either in the dispenser 10 or the container may be transferred from the dispenser 10 to another apparatus that places the top on the container 20.

One example of a one-way valve is a silicon top available from Liquid Molding Systems, Inc. from Midland, Mich. The valve top is secured to the container 20 prior to filling by the manufacturer. Then, the consumer simply takes the container and places it into the dispenser 10. The nozzle is able to pierce the valve top and fill the container 20 as previously described. Then, when the nozzle is withdrawn through the valve top, the valve top seals and the liquid does not spill from the dispenser 10. However, upon applying sufficient pressure to the container 20, the liquid inside of the container 20 will be able to be dispensed through the valve top.

The containers 20 may be collapsible or nestable. The use of the valve top is particularly advantageous with collapsible containers. The filling of the collapsible container, with a valve top, is accomplished by the filling of the container with the liquid from the nozzle.

A load cell, that senses weight, may be incorporated into the dispenser 10. The load cell could be located at the portion of the dispenser on which the container 20 is placed. One use of the load cell would be to sense the weight of the container that is placed in the dispenser 10. The load cell would verify the weight of the container and transfer this information to the dispenser 10. There, the various weights of different containers would be stored and the weight of the container would be compared to the potential products to be dispensed. This could replace the use of a bar code to identify the product, size and other information. This would, of course, require that each product to be dispensed would be dispensed into a container having a different weight.

Another use of the load cell would be to monitor the weight of the container as the container is being filled by the nozzle. As the weight increases, the load cell sends a signal to the nozzle assembly to start pulling up, so as to keep the end of the nozzle out of the liquid and therefore prevent dripping once the container is filled. Also, the rate of dispensing could be varied as the container became heavier, thereby reducing the chance of foaming. Each container would have a profile that would be stored in the dispenser 10 that would correlate the weight to the height of the liquid in the container so as to allow the nozzle assembly to retract without touching the liquid and to be always above the surface of the liquid as it is being filled.

FIGS. 4–10 and 13–16 show another embodiment which utilizes a turret assembly, generally designated at 100. The dispenser 210 includes a housing 211. The housing 211 has a display area 212 on which promotional material may be applied. The housing 211 includes a plurality of shelves 213 on which different styles of containers 220, 221, 222 and 223 may be stored. While not shown, the containers 220–223 will also have a label, similar to label 22, as shown in the first embodiment. A cabinet 224 houses the turret assembly 100. An informational screen 218 is operatively connected to the housing 211. A shield 216, a product support shelf or pad 225 is supported by the cabinet 224, by means well known in the art. The product support shelf 225 may include a load cell or other weighing mechanism to weigh the container 220, and any product placed in the container 220. The container, referred to as 220 hereinafter, could be any container 220–224 or other suitable container. A bar code reader 226 is operatively connected to the cabinet 224. Also, photo detectors 227 are operatively connected to the cabinet 224 and are used for verifying the presence of the container 220. The turret assembly 100 has four nozzles, as compared to the three nozzles shown in FIGS. 1 through 3. However, it is understood that any suitable number of nozzles may be utilized to incorporate the features of the turret 100. The turret has two nozzle assembly 101, 102 for dispensing a more viscous product and two nozzle assembly 103, 104 for dispensing a less viscous product. The nozzle assembly 101, 102 are the same in their construction. The nozzle assembly 103, 104 are of similar construction.

The turret assembly 100 is mounted for rotation in the dispenser 210 by rotation around a shaft 105. The shaft 105 is secured in the dispenser 210 by means well known in the art. The shaft 105 has a top end 105*a* that is secured to an upper cross member 224*a* of the cabinet 224. The second or bottom end 105*b* is secured by means well known in the art to a lower cross member 224*b* of the cabinet 224. The turret assembly 100 includes a bottom plate 106 and a top plate assembly 107. The top plate assembly includes an upper plate 107*a* and a lower plate 107*b* operatively connected and spaced apart by suitable means such as stand offs 108. The bottom plate 106 is operatively connected to the top plate assembly 107 by a plurality of guide rods 109–114, which are operatively connected to the bottom plate 106 and the lower plate 107*b* by suitable means such as a bolted, welded or threaded connection. Bearings 115, 116 are utilized to rotatably mount the turret assembly 100 to the shaft 105. A gear 117 is fastened to the bottom plate 106. A motor 118 is mounted to the shaft 105. The motor 118 has a gear 118*a*. The gear 118*a* meshes with the gear 117, wherein rotation of the motor 118 causes rotation of the gear 117 and thereby the turret assembly 100 about the shaft 105. As compared to the first embodiment, the use of a rotatable turret assembly 100 allows for only one filling station in the dispenser. That is, the container to be filled in placed in one position in the dispenser and the turret assembly 100 is rotated to bring the appropriate nozzle assembly 101–104 into position.

The nozzle assemblies 101, 102 are similar in construction and provide for the dispensing of a concentrate through each one of the nozzle assemblies 101, 102. The nozzle assemblies 101, 102 are more specifically designed for a viscous product. Only one of the nozzle assemblies 101 will be described in detail as nozzle assembly 102 is similar. The nozzle assembly 101 includes a rod 119 having a worm gear 119*a* on its outside surface. It should be noted that the worm gear 119*a* is only shown in FIG. 9, it being understood that the worm gear would appear in the other figures, except has been removed for illustration. The rod 119 is mounted in the top plate assembly 107 by a bearing 120. A gear 121 is mounted around the rod 119. The gear 121 has an outer circumference having teeth 121*a* which are driven by motor 122 which has a gear (not shown) which meshes with the teeth 121*a*. A worm wheel (not shown) is carried by the gear 121. The worm wheel engages the worm gear 119*a* and thereby causes the rod 119 to move vertically, depending upon the rotation of the motor 122. The rod 119 is operatively connected to a housing 123 by suitable means such as welding. A lever assembly 124 has a first arm 125 pivotally connected to a second arm 126. The first arm is also pivotally connected to the housing 123 by a pin 127. The pin 127 is mounted on both sides of the arm 125 and is positioned in openings formed in the housing 123. The arm 125 has a distal end 125*a*. The distal end 126*a* of the second arm 126 is mounted on a pin 128 to which two cylinders 129 are mounted. The cylinders 129 are slidable in slot 123*a* formed in the housing. A dispensing tube 129 has a bore 129*a* extending therethrough. The bore 129*a* has an inlet 130 and an outlet 131. A stop 132 has an incline surface 132*a*. The stop 132 is a plunger, plug or closure, or any member that can shut off flow of the liquid. The incline surface 132*a* mates with a mating surface 129*b* formed at the outlet 131. The inclined surface 132*a* is preferably at a 45 degree angle and will form a seal when the inclined surface 132*a* is in contact with the mating surface 129*b*. The stop 132 is secured to a first end 133*a* of a connecting member 133. The second end 133*b* is secured to the distal end 126*b* of the second arm 126 by a clamp 134. An O-ring 135 is secured about the connecting member 133. The housing 123 has an inner cavity in the shape of a cylindrical bore and the O-ring 135 prevents the liquid from going upward in the nozzle assembly and makes certain that the ready-to-use product goes through the bore 129*a*. Two guide rods 109, 110 are positioned proximate the dispensing tube 129. A sliding block 136 is positioned and secured to the right of the guide rods 109, 110, when viewed in FIG. 5. The sliding block, while not shown in FIGS. 4–6 would be positioned approximately at the point designated by X in FIG. 5. A spring 137 is positioned around the dispensing tube 129 and between the pin 128 and the inlet tube 138. The spring biases the plunger 32 to its closed position. The inlet tube 138 has a bore 138*a*. The bore 138*a* has a first opening to receive the concentrate and diluent and a second opening which goes into the cavity formed by the housing 123. The bore 138*a* is in fluid communication with the bore 129*a*.

Figure 10:
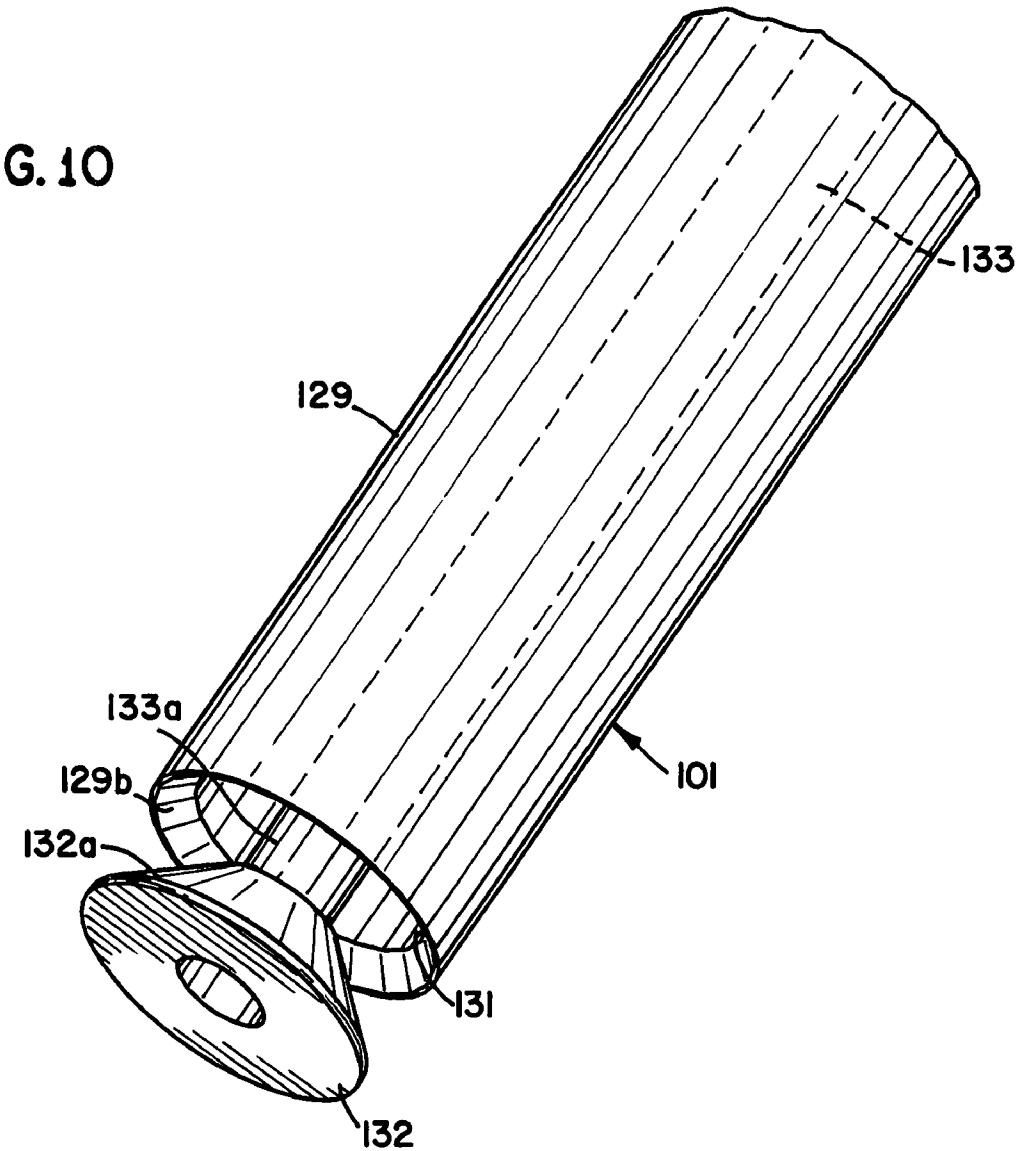
FIG. 10 is an enlarged perspective view of the bottom of the nozzle assembly shown in FIG. 7.
Figure 11:
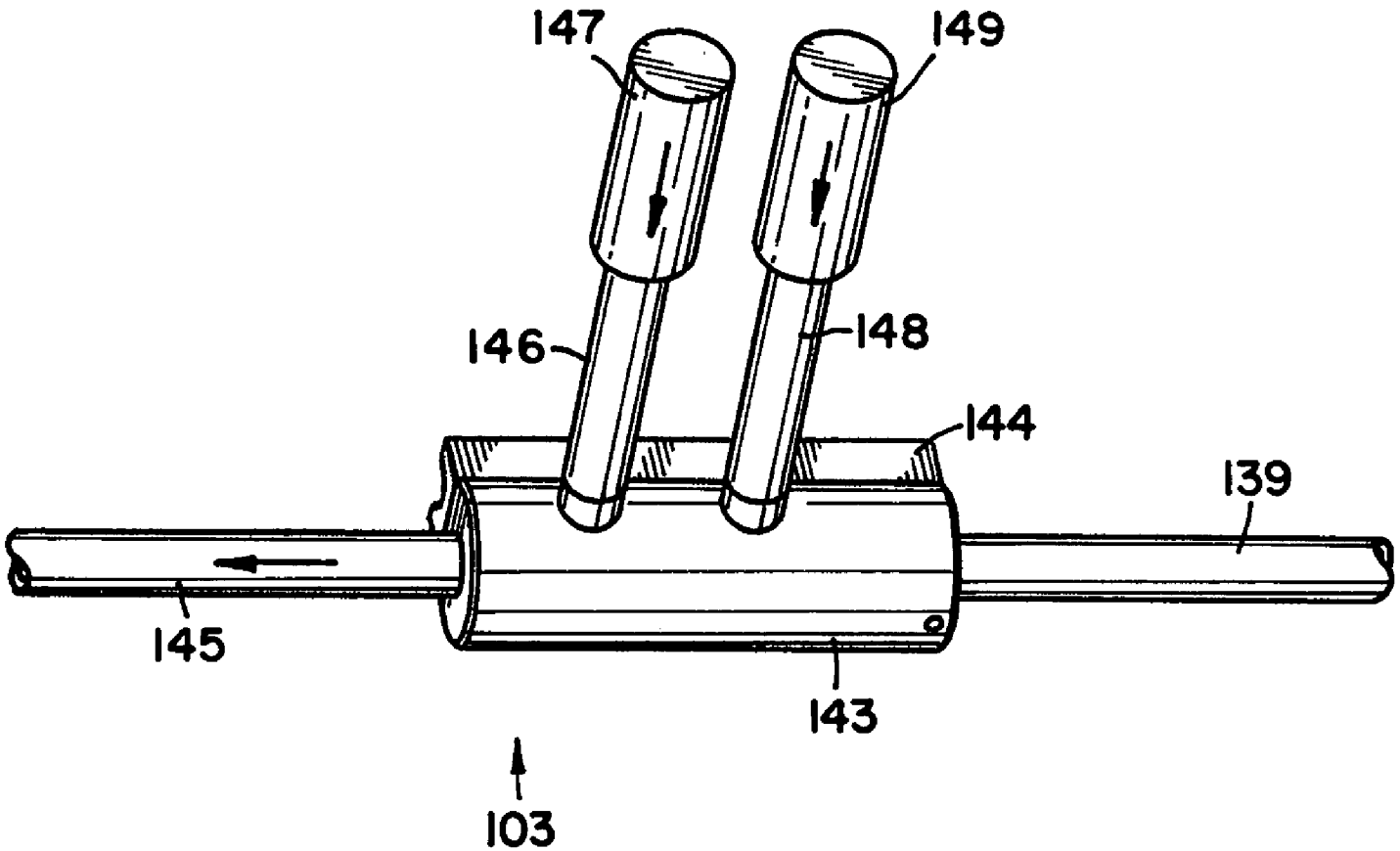
FIG. 11 is a perspective view of another nozzle assembly shown in FIG. 5.
Figure 12:
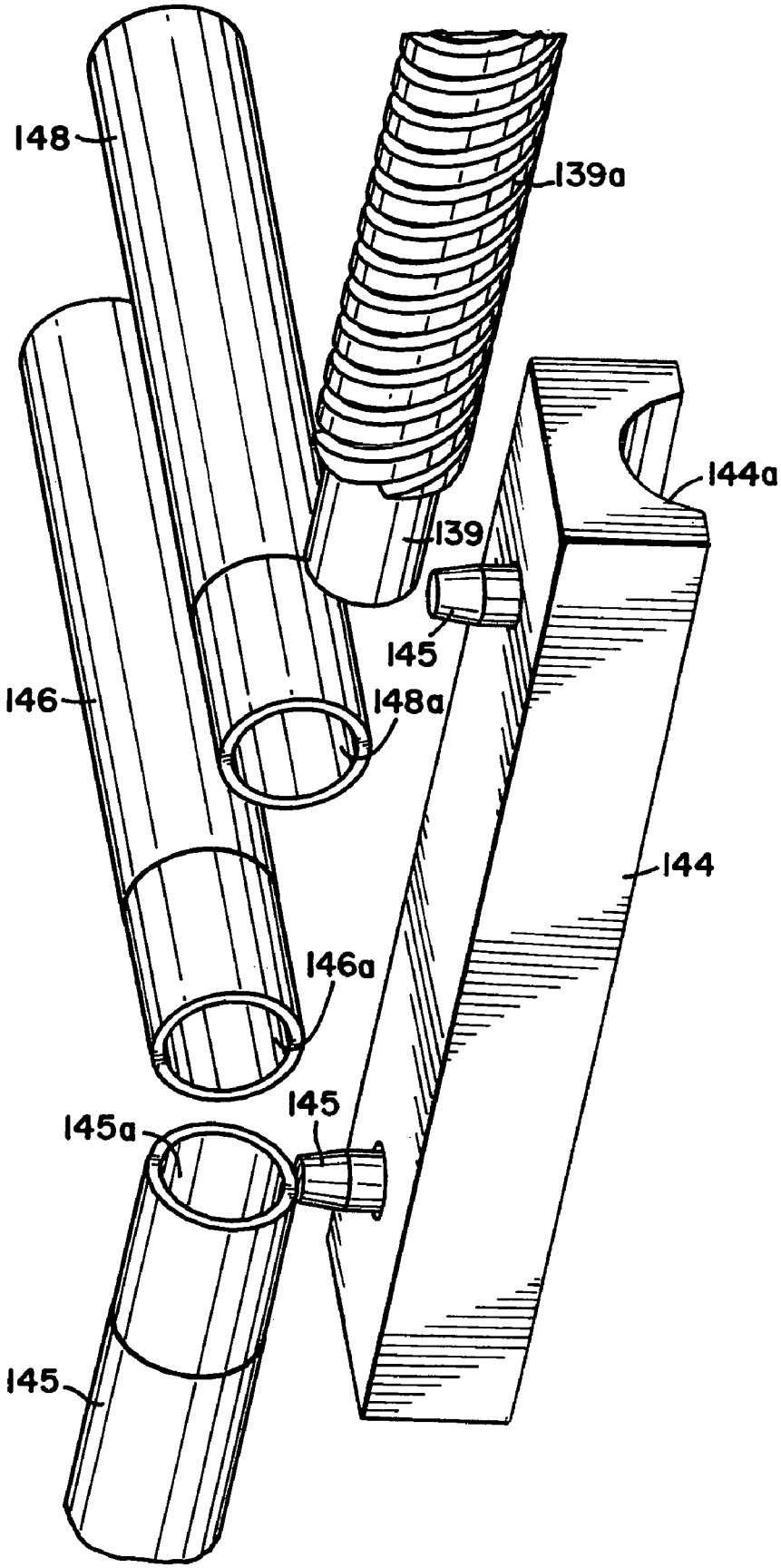
FIG. 12 is an exploded perspective view of the nozzle assembly shown in FIG. 11 with the outer housing removed.

In operation, the nozzle assembly 101 is shown in a closed position in all of the Figures except for FIG. 10, where it is shown in an open position. The motor 122 is actuated thereby causing rotation of the gear 121 which has a worm wheel (not shown) which engages the worm gear 119*a*. This causes the rod 119 to move downward. As the rod 119 moves downward, the housing 123 also moves downward. This causes the distal end 129*a* to contact the sliding block 136 which causes movement of the lever assembly 124. This movement of the lever assembly 124 forces the distal end 126*a* downwards, thereby moving the plunger from a closed position to an open position, as shown in FIG. 10. When the motor 122 is reversed, the previously described motion is reversed, thereby causing the stop 132 to be moved to a closed position with respect to the dispensing tube 129. This prevents the dripping of a more viscous product after the container has been filled. The rotation of the motor 122 causes the dispensing tube to go into the container to be filled into a position just above the bottom of the container 220. Then, as the ready-to-use product is dispensed in the container 220, the motor 122 rotates to cause the nozzle assembly 101 to move upward, thereby keeping the end of the dispensing tube 129 above the rising level of the ready-to-use product in the container 220. This keeps the end of the dispensing tube 129 clear from the ready-to-use product and minimizes dripping when the nozzle assembly 101 is in the up position and the dispensing has been completed.

Referring now to FIGS. 4–6 and 11–12, the nozzle assemblies 103, 104 will be described in more detail. Again, the nozzle assembly 104 is similar to the nozzle assembly 103. The nozzle assembly 103 includes a rod 139 having a worm gear 139*a*. The rod 139*a* is mounted to the top plate assembly 107 by a bearing 140. A gear 141 is mounted about the rod 139 and is driven by a motor 142. This vertical movement of the rod 139 is the same as with respect to the rod 119 of nozzle assembly 101 and will not be described in more detail. The rod 139 is connected to a housing 143 which forms an inner cavity. The housing 143 has been removed from FIG. 12 to show the other components more clearly. The rod 139 is operatively connected to the housing 143 by suitable means such as welding. A guide block 144 has an indentation 144*a*. The indentation 144*a* provides for a surface for the guide block 144 to be guided by the guide rod 111. The guide block 144 is connected to the housing 143 by suitable means such as rivets 145. The guide block 144 and guide rod 111 guide the nozzle assembly 103 as it moves vertically. A dispensing tube 145 has a bore 145*a* that extends through the dispensing tube. The bore 145*a* has a first end in fluid communication with the cavity formed in the housing 143 and a second end which is in fluid communication with the container 220 as it is being filled. An inlet tube 146 has a bore 146*a* that places the concentrate and diluent in fluid communication with the cavity in the housing 143. A check valve 147 is placed in the inlet tube 146 and allows for the diluent and concentrate to only flow in the direction of the arrow shown in FIG. 11. An air inlet tube 148 has a bore 148*a* that extends through the inlet tube 148. A check valve 149 is secured to the inlet tube 148 and allows air to flow only in the direction of the arrows shown in FIG. 11. Since the nozzle assemblies 103, 104 are used for less viscous products, there is not as great as problem with dripping and the stop 132 is not utilized. However, the check valve 149 provides for additional drainage to prevent dripping. As the concentrate and diluent are dispensed through the inlet tube 146, there is some head pressure in the cavity in the housing 143 and air does not flow through the check valve 149. However, when the concentrate and diluent are no longer being pumped through the inlet 146, air does flow through the check valve 149 thereby allowing for better drainage of any liquid left in the dispensing tube 145.

Figure 13:
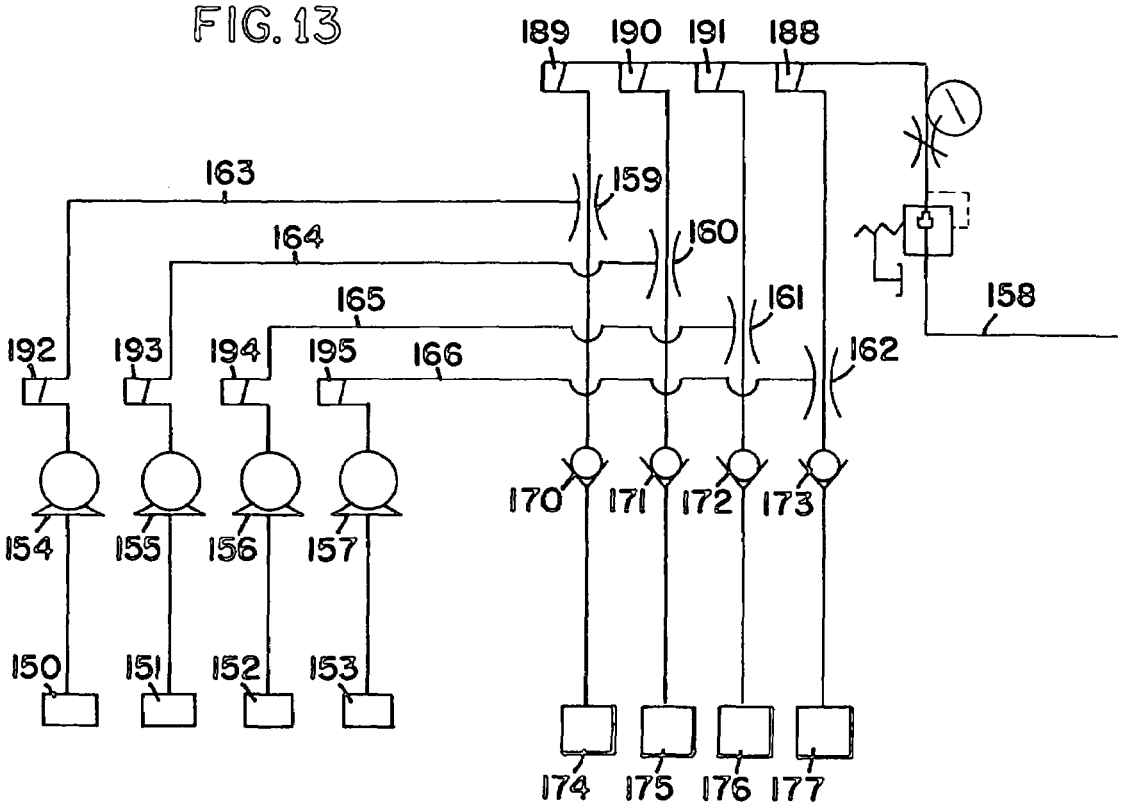
FIG. 13 is a schematic diagram of the plumbing for use with the turret assembly shown in FIG. 4.

FIG. 13 shows a flow diagram for four separate concentrates 150–153 that are pumped by four pumps 154–157. Water, the diluent, enters the water line 158 and is connected to four venturis 159–162. The lines 163–166 which connects the concentrates 150–153 to the venturis 159–162 are connected to the low pressure side of the venturis 159–162. This system uses water pressure to deliver the products and allows for a higher viscous concentrate to be delivered with less expensive components. The pumps 154–157 pump the concentrates 150–153 to the low pressure area of the venturis 159–162. The pumps 154–157 act as a metering device and the venturis 159–162 are utilized to assist in the delivery of the concentrates which may be more viscous by this connection. Check valves 170–173 are placed in the lines 163–166 after the venturis 159–162 to allow flow of liquid in only one direction. The lines 163–166 are operatively connected to connectors 174–177, which are in turn connected to the nozzle assemblies 102–104. The use of venturis are most beneficial when the product is viscous and are optional for lower viscous products.

Figure 14:
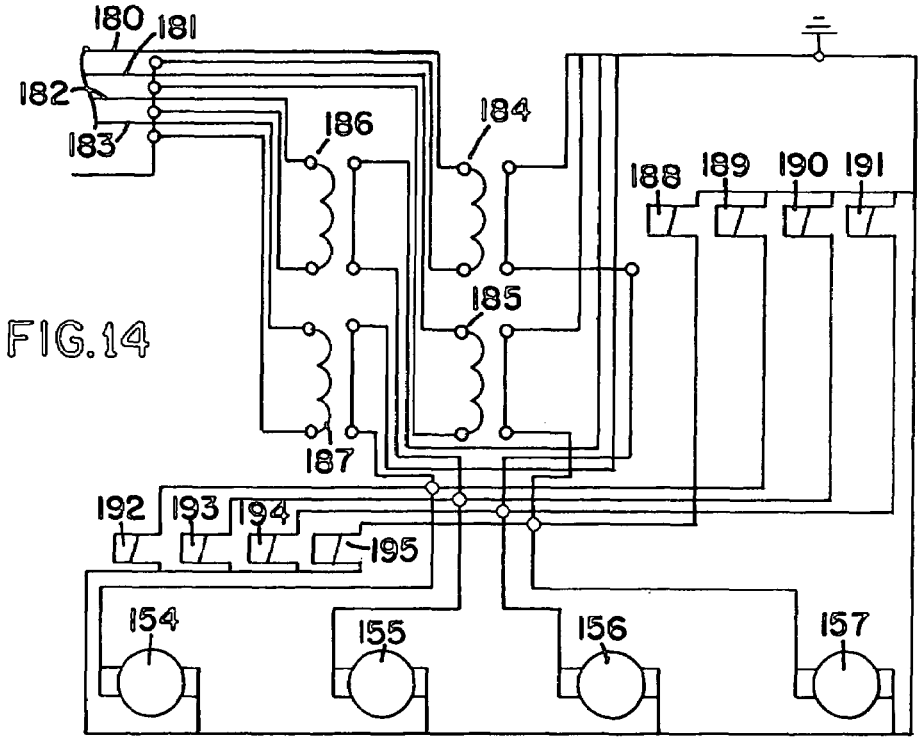
FIG. 14 is an electrical schematic for the turret assembly shown in FIG. 4.
Figure 15:
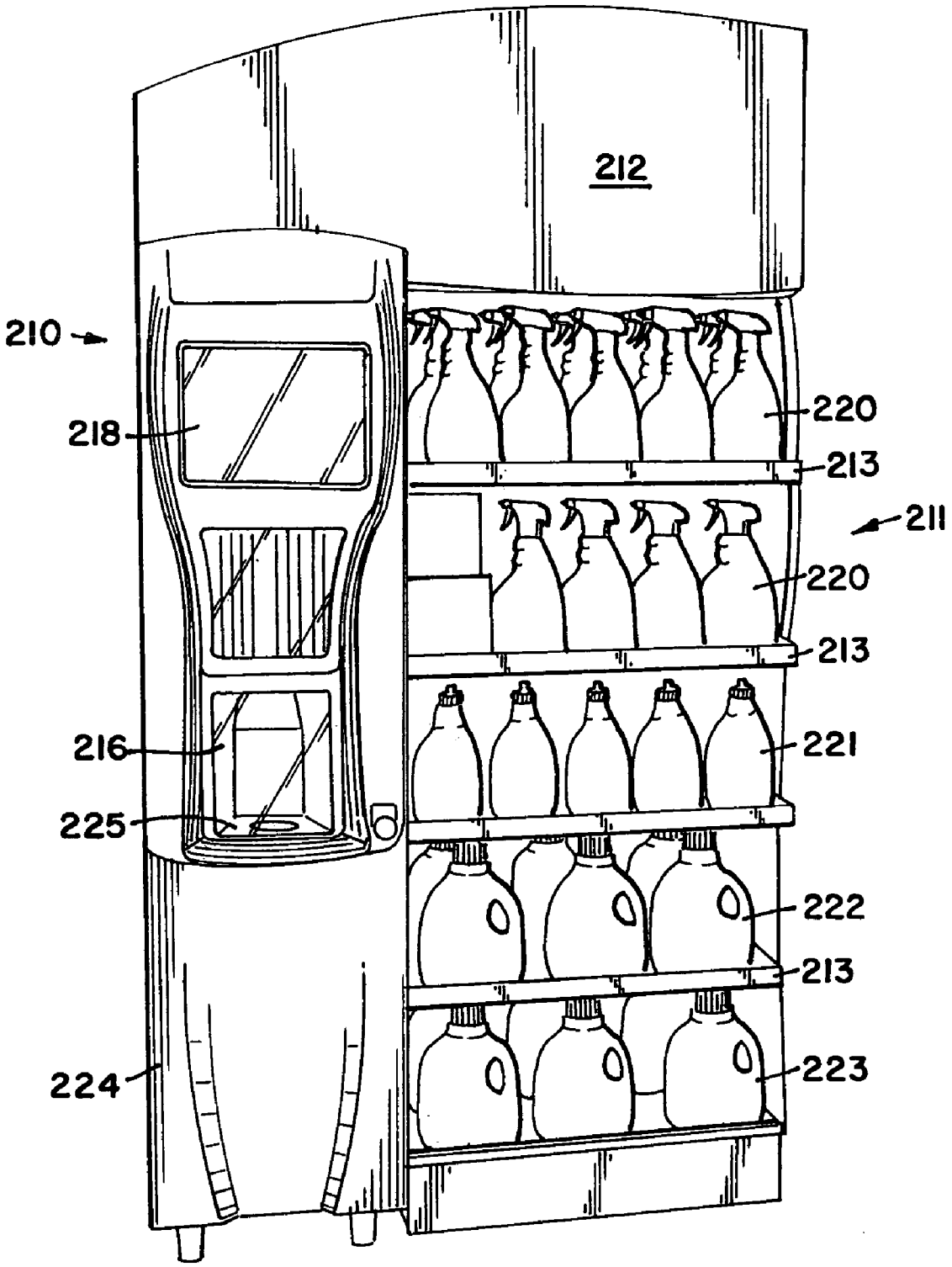
FIG. 15 is a dispenser showing the second embodiment, shown in FIGS. 4–10 and 13–14.
Figure 16:
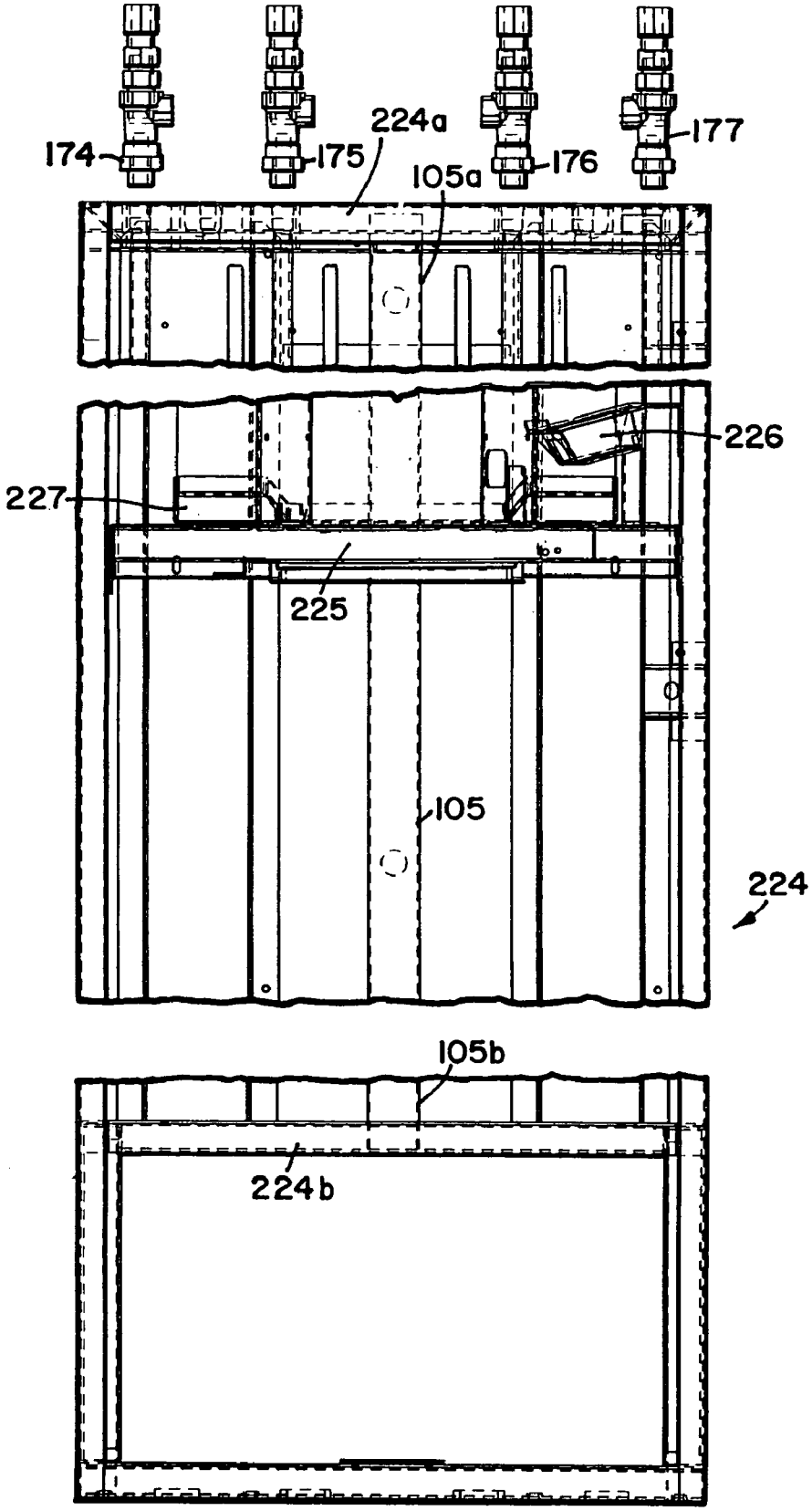
FIG. 16 is a cross-sectional view of FIG. 15 of the cabinet for housing the turret assembly shown in FIG. 4.

FIG. 14 is an electrical schematic showing the operation of the dispenser shown in FIG. 13. Generally, there are four buttons on the dispenser which are depressed depending upon the type of concentrate desired. When the button is pressed, a 24-volt signal will pass through a relay which will in turn energize two solenoids. A first solenoid will allow flow of the concentrate and the second solenoid will open a valve to allow the diluent to enter the diluent passageway to the venturis and then a relay activates the pump motor for pumping of concentrates. It can therefore be seen that the button connected to wire 180 will energize solenoids 191, 194 through relay 184. The relay 184 will activate pump 156 and solenoid 191 will allow diluent to the venturi 161.

The button connected to wire 181 will energize solenoids 188, 195 through relay 185. The relay 185 will activate pump 157 and solenoid 188 will allow diluent to the venturi 162.

The button connected to wire 182 will energize solenoids 190, 193 through relay 186. The relay 186 will activate pump 155 and solenoid 190 will allow diluent to the venturi 160.

The button connected to wire 183 will energize solenoids 189, 192 through relay 187. The relay 187 will activate pump 154 and solenoid 189 will allow diluent to the venturi 159.

The flow from the venturis 159–162 would then be directed by suitable tubing to the nozzle assemblies 101–104 for dispensing into a container 220.

In addition, when dispensing some ready-to-use products, it is advantageous to have a very thick product as the consumer has associated the thick product with a high performing product. When preparing a thick product for dispensing into the container 220, it would typically be required to utilize a concentrate that has even a higher viscosity as it is diluted with a diluent such as water. The dispensing of highly viscous concentrates is difficult. Applicants have found that it is sometimes advantageous to dispense two separate concentrates into a single container 220 to provide for a viscous ready-to-use product. This is because the ready-to-use product, i.e., a laundry detergent, is formed from two concentrates that together gel. If these two concentrates are mixed together beforehand the gelled product is very thick and it is hard to deliver to the diluent to be diluted. However, Applicants have found it advantageous to dispense each of the concentrates separately so as to avoid the gelling of the two concentrates until just prior to entering the container 220. For instance, in preparing a laundry detergent, two concentrates such as builder concentrate and surfactant concentrate may be utilized. The builder concentrate has a viscosity of less than 150 cps and surfactant concentrate has a viscosity of less than 150 cps. If concentrates are mixed together, they will gel and have a viscosity of from 150 to 800 cps. This would be a very difficult combination to dispense. Accordingly, the two concentrates are kept separate until they are dispensed. A very straightforward modification to the previously described dispenser would allow the combination to two of the diluted concentrates to come out of two of the venturis 159–162 to be combined into one nozzle assembly.

The ready-to-use concentrates for such higher viscous products will have a viscosity of 150 cps or greater, preferably 300 cps or greater. Such ready-to-use products may even go up to a viscosity of 500 cps. It is understood that this method would of course be useful for other concentrates than the two noted above. The method is especially applicable where two concentrates are used that both have viscosities which are less than the viscosity of the combination of the two concentrates. The method is also applicable to use of two concentrates that are otherwise incompatible.

In addition to using the present invention to combine two concentrates as discussed above, it is also envisioned that the first concentrate could be a builder concentrate such as those disclosed in the first paragraph under the Detailed Description of the Invention. The second concentrate could be picked by the customer and could be a fragrance, dye, surfactant, etc. This would allow for the end product to be customized by the purchaser. Further, a third concentrate could be added, the third concentrate also selected from a dye, fragrance or surfactant, etc., to further customize the end product.

As previously discussed, the nozzle assemblies 103, 104 are for low viscous products. One advantage of low viscosity is that the products may subsequently be foamed by the consumer. Such low viscosity products, after dilution, will have a viscosity of 150 cps or less. It is more preferred that the ready-to-use product, after dilution, has a viscosity of 100 cps or less and more preferably 40 cps or less to provide for a better foaming product.

Applicants have further determined that is advantageous, under certain circumstances, to have the capabilities of indicating on the container 220 when the container 220 was filled. Also, it is sometimes advantageous to have the capabilities of also indicating the day that the concentrate was produced. Having the production date of the concentrate or the filling date of the container 220 may be advantageous for one or more of the following reasons. There are regulatory requirements for certain volatile organic compounds (VOC). These regulatory requirements require that the production date/filling date be on the container. Having the dates available would also aid in recall of the filled container 220, if necessary. The date would also be beneficial in product tracking. That is, if there is a new product or formula, one would be able to trace back any inquiries or complaints to the date that the container 220 was filled and/or the concentrate made. One additional benefit is to tie the application of the production date to the issuance of a coupon to encourage the purchase of the product. Finally, the indicia may also indicate the expiration date of the use solution, if applicable.

The indicia, to indicate the fill date or the date the concentrate was produced, may be placed on the container by a suitable printer, well known in the art. However, to have a printer place the dates or code on the container 220 is somewhat costly and there is higher maintenance in keeping such printers operational. Another option, which is preferred, is to have a printer, either adjacent or incorporated into the dispenser, that prints a label. The label would be applied by the customer on to the container 220. The printing of the label having the dates or code could also incorporate the printing of a coupon for a discount for the purchaser, either for this sale, for a future sale, or both. The coupon could also be structured such that it would encourage the use of consumer applying the label by having the coupon valid only with containers 220 that have a label with the indicia information applied. The label may include a code that is able to be scanned.

In addition, the concentrate 32, 34, 36 may be placed in a concentrate product container that has a scannable code. The scannable code on the concentrate product container may be utilized to update the date of manufacture of the concentrate 32, 34, 36. This information is in turn utilized in printing the indicia on the container 220 at the dispenser. Further, the scannable code on the concentrate product container may be removable from the concentrate product container so that it may be removed from the concentrate product container and taken to the dispenser 10 and scanned into the dispenser. This is especially advantageous when the concentrates are at a remote site so that the concentrate product container does not have to be moved or handled up to the dispenser. It is also useful if the concentrate 32, 34, 36 is located adjacent the dispenser in that the label will be easier to scan than manipulating the concentrate product container to allow the label to be scanned. The indicia that is either printed on the containers 220 or on the label that is placed on the container 220 may be printed with multiple dates, such as the fill date, concentrate manufacturing date or expiration date. The foregoing describes uses of the present invention. Other uses and methods are described in an application Ser. No. 10/434,392 filed on even date herewith, entitled "Method and System of Providing a Product in a Refillable Container and a Refillable Container", inventors Allan L. Schuman, Tina O. Outlaw, Bryan M. Anderson, and Keith E. Olson, which is hereby incorporated by reference.

Although the present invention has been described with reference to particular embodiments, it should be understood that those skilled in the art may make many other modifications to the present invention without departing from the spirit and scope of the invention which is defined by the appended claims.

We claim:

1. A method of diluting a cleaning concentrate to form a ready-to-use consumer product for consumer markets, comprising:

a) providing a source of locally supplied diluent, that is not shipped in, to a dispenser having a fill station;

b) providing a container of first concentrate at a remote site, the supply of first concentrate is located in an area out a visual line of sight from the dispenser;

c) providing a first product container;

d) picking one of the containers;

e) placing said container in fill station;

f) identifying the container by the dispenser;

g) determining fill date and placing indicia with the fill date on the first product container; and h) filling at the filling station the product container with an amount of diluent and concentrated cleaning in a predetermined amount.

2. The method of claim 1, further comprising:

a) removing a fitment from the first container prior to placing in the dispenser; and b) reapplying the fitment to the first container after filling.

3. The method of claim 1 wherein the dispenser has two or more filling stations.

4. The method of claim 1 wherein there are two or more concentrates.

5. The method of claim 4 wherein there are the same number of fill stations as concentrates.

6. The method of claim 4 wherein there is a single fill station servicing multiple concentrates.

7. The method of claim 6 wherein a filling nozzle at the filling station containing the ready-to-use consumer product is rinsed between each dispensing.

8. The method of claim 1 wherein the diluent is water.

9. The method of claim 8 wherein the water is pretreated prior to mixing with said concentrate and the identifying occurs by a scannable code.

10. The method of claim 1 wherein the identifying occurs as a result of the shape of the footprint of the container.

11. The method of claim 1 wherein the identifying results from an indentation of the container.

12. The method of claim 1 wherein the identifying occurs as a result of a projection from the container.

13. The method of claim 1, wherein the dispenser is able to dispenser more concentrates than if the concentrate were proximate the dispenser.

14. The dispenser of claim 13, wherein the dispenser has fewer fluid connections in the store when the concentrates are located in the area out of visual line of sight from the dispenser.

* * * * *

UNITED STATES PATENT AND TRADEMARK OFFICE

CERTIFICATE OF CORRECTION

PATENT NO. : 7,131,468 B2
APPLICATION NO. : 10/434430
DATED : November 7, 2006
INVENTOR(S) : Schuman et al.

It is certified that error appears in the above-identified patent and that said Letters Patent is hereby corrected as shown below:

Col. 14, line 30: “and concentrated cleaning in” should be --and cleaning concentrate in--

Col. 14, line 58: “dispenser” should be --dispense--

Col. 14, line 61: “the” (first occurrence) should be --a--

Signed and Sealed this

Thirty-first Day of March, 2009

JOHN DOLL
*Acting Director of the United States Patent and Trademark Office*